US009540194B2

(12) United States Patent
Deng et al.

(10) Patent No.: US 9,540,194 B2
(45) Date of Patent: Jan. 10, 2017

(54) SHEET-TYPE MEDIUM SEPARATING APPARATUS AND SELF-SERVICE FINANCIAL DEVICE

(71) Applicant: GRG Banking Equipment Co., Ltd., Guangzhou, Guangdong (CN)

(72) Inventors: Xiaohua Deng, Guangdong (CN); Zhe Li, Guangdong (CN); Huan Xu, Guangdong (CN)

(73) Assignee: GRG Banking Equipment Co., Ltd., Guangzhou, Guangdong (CN)

( * ) Notice: Subject to any disclaimer, the term of this patent is extended or adjusted under 35 U.S.C. 154(b) by 0 days.

(21) Appl. No.: 15/021,921

(22) PCT Filed: Nov. 24, 2014

(86) PCT No.: PCT/CN2014/092015

§ 371 (c)(1),
(2) Date: Mar. 14, 2016

(87) PCT Pub. No.: WO2015/096573

PCT Pub. Date: Jul. 2, 2015

(65) Prior Publication Data

US 2016/0229648 A1 Aug. 11, 2016

(30) Foreign Application Priority Data

Dec. 24, 2013 (CN) ..... 2013 1 0724154

(51) Int. Cl.
*B65H 3/52* (2006.01)
*B65H 3/06* (2006.01)

(52) U.S. Cl.
CPC ..... *B65H 3/5246* (2013.01); *B65H 3/0638* (2013.01); *B65H 3/0653* (2013.01);
(Continued)

(58) Field of Classification Search
CPC ..... B65H 3/0638; B65H 2404/173; B65H 2404/1415
See application file for complete search history.

(56) References Cited

U.S. PATENT DOCUMENTS 4,496,145 A 1/1985 Fukui
4,858,905 A 8/1989 Weigel
(Continued)

FOREIGN PATENT DOCUMENTS

CN 1258896 A 7/2000
CN 100999287 A 7/2007
(Continued)

OTHER PUBLICATIONS

Written Opinion, dated Feb. 6, 2015, from corresponding International Application No. PCT/CN2014/092015.
(Continued)

*Primary Examiner* — Howard Sanders
(74) *Attorney, Agent, or Firm* — Wolf, Greenfield & Sacks, P.C.

(57) ABSTRACT

A sheet-type medium separating apparatus applicable in a self-service financial device for reliable sheet-by-sheet separation of an entire stack of banknotes. The apparatus includes a pickup roller component; a reversal roller component; and a separation roller component, where the reversal roller component includes a reversal roller, the reversal roller is fitted onto a reversal roller shaft via a one-way bearing, the reversal roller is provided with an inner sleeve cylinder fixed with the one-way bearing and a reversal roller sleeve sleeved onto the inner sleeve cylinder and capable of moving axially and flexibly. The separating apparatus allows for automatic adjustment of the meshing clearance between the reversal roller and the separation roller on the basis of the thickness of sheet-type media to be separated, thus effec-
(Continued)

tively solving the problem of the sheet-type media being jammed or torn.

16 Claims, 6 Drawing Sheets

(52) U.S. Cl.
CPC ..... *B65H 2404/1121* (2013.01); *B65H 2404/11221* (2013.01); *B65H 2404/133* (2013.01); *B65H 2404/1415* (2013.01); *B65H 2404/17* (2013.01); *B65H 2701/1912* (2013.01)

(56) References Cited

U.S. PATENT DOCUMENTS

| | | | | |
|---|---|---|---|---|
| 5,901,951 | A | 5/1999 | Yamaguchi | |
| 6,186,490 | B1 | 2/2001 | Sugiura et al. | |
| 6,585,252 | B1 * | 7/2003 | Russo | B65H 5/008 271/122 |
| 2007/0096383 | A1 | 5/2007 | Nishimura et al. | |
| 2008/0136087 | A1 | 6/2008 | Terao et al. | |
| 2011/0156337 | A1 * | 6/2011 | Pan | B65H 3/0676 271/4.1 |
| 2012/0061905 | A1 | 3/2012 | Wu et al. | |

FOREIGN PATENT DOCUMENTS

| | | | |
|---|---|---|---|
| CN | 101003332 | A | 7/2007 |
| CN | 101195447 | A | 6/2008 |
| CN | 101580183 | A | 11/2009 |
| CN | 202102531 | U | 1/2012 |
| CN | 103708250 | A | 4/2014 |
| EP | 0994445 | A2 | 4/2000 |
| JP | S57151962 | A | 9/1982 |
| JP | H07251958 | A | 10/1995 |

OTHER PUBLICATIONS

International Search Report, dated Feb. 6, 2015, from corresponding International Application No. PCT/CN2014/092015.

* cited by examiner

SHEET-TYPE MEDIUM SEPARATING APPARATUS AND SELF-SERVICE FINANCIAL DEVICE

This application is the national phase of International Application No. PCT/CN2014/092015, titled "SHEET-TYPE MEDIUM SEPARATING APPARATUS AND SELF-SERVICE FINANCIAL DEVICE", filed on Nov. 24, 2014, which claims priority to Chinese Patent Application No. 201310724154.0 titled "SHEET-TYPE MEDIUM SEPARATING DEVICE AND SELF-SERVICE FINANCIAL EQUIPMENT", filed with the Chinese State Intellectual Property Office on Dec. 24, 2013, which applications are hereby incorporated by reference to the maximum extent allowable by law.

FIELD

The present application relates to the sheet medium processing technology, and in particular to a sheet-type medium separating device applicable in a financial self-service equipment to individually separate a whole stack of banknotes reliably.

BACKGROUND

The current financial self-service equipment has a banknote depositing and withdrawing module for depositing and withdrawing banknotes, an identification module for identifying the deposited banknotes, a temporary storage device for temporarily storing the identified banknotes, a cashbox for storing the eventually identified and confirmed banknotes, a necessary system control device, and etc.

When the above financial self-service equipment handles the banknotes deposited by the user, a whole stack of banknotes placed into the banknote depositing and withdrawing module are separated individually by a banknote separating device in the banknote depositing and withdrawing module, and enter through a banknote conveying passage into the identification module provided in the conveying passage, and the banknotes identified by the identification module are conveyed to the temporary storage device or the banknote depositing and withdrawing module according to the identification results. Thus, the banknote depositing and withdrawing module of the current financial self-service equipment consists of two isolated spaces, one is a receiving space for receiving the whole stack of banknotes placed in by users, and the other is a returning space for receiving the banknotes which are unaccepted after being identified by the identification module and need to be returned to the users.

Currently, most of banknote separating devices for individually separating the whole stack of banknotes are of friction-type, for example, the separating devices disclosed in Chinese patent application No. CN1999287A and Chinese patent application No. CN201567095U, the friction-type separating mechanism is mainly composed of a reverse roller assembly 1, a pickup roller assembly 2 and a separating roller assembly 3 as shown in FIG. 1.

In the process of separating the banknotes, as shown in FIG. 2, the banknotes 4 are individually separated in the direction from top to down, at this time, the pickup roller assembly 2 and the separating roller assembly 3 provide a downward impetus for the separated banknote, while a reverse roller assembly shaft 1 provides a resistance for the separated banknote, and mainly functions to prevent the second and subsequent banknotes from entering into a separation meshing zone as shown in FIG. 3, and FIG. 3 is a top view of FIG. 1, and FIG. 4 is a partially enlarged view of the reverse roller assembly and the separating roller assembly in FIG. 3. The individually separation of the whole stack of banknotes is achieved by the radial interference fit between the reverse roller assembly 1 and the separating roller assembly 3, and the banknote has a very small thickness, by taking a domestic banknote with a face value of RMB 100 Yuan as an example, the thickness of a single sheet of the banknote at the position of an anti-counterfeiting string is about 0.15 mm, and the thickness of the single sheet of banknote at other positions is about 0.1 mm, therefore the theoretical axial distance between the reverse roller assembly 1 and the separating roller assembly 3 is relatively small, and the accuracy during processing and assembling is required to be extremely high.

Moreover, different positions of the banknote of the same type has different thicknesses, and when the banknotes having a thickness difference pass through the passage, with a fixed clearance, between the reverse roller assembly 1 and the separating roller assembly 3, the banknotes may be jammed or torn in the separating process.

SUMMARY

In order to address the technical issue that sheet-type media are jammed or tore when the sheet-type media having a thickness difference are separated by the above separating mechanism, a sheet-type medium separating device is provided, in which an axial clearance between an end of a reverse roller assembly 1 and an end of a separating roller assembly 3 can be automatically adjusted.

The sheet-type medium separating device includes:

a pickup roller assembly configured to frictionally convey one sheet of sheet type medium, in contact with the pickup roller assembly, in a whole stack of sheet-type media;

a reverse roller assembly configured to block the whole stack of sheet-type media to prevent more than one sheet of the sheet-type media from being frictionally conveyed; and a separating roller assembly arranged opposite to the reverse roller assembly with a clearance passage being formed between the separating roller assembly and the reverse roller assembly to convey a single sheet of the sheet-type media, and the separating roller assembly configured to provide a conveying power for a single sheet of the sheet-type media conveyed frictionally by the pickup roller assembly;

wherein the reverse roller assembly includes a reverse roller, the reverse roller is assembled onto a reverse roller shaft through a one-way bearing, and the reverse roller includes an inner sleeve fixed to the one-way bearing and a reverse roller jacket sleeved on the inner sleeve and movable axially and elastically.

Preferably, an accommodating groove is provided in an outer surface of the inner sleeve in an axial direction, a protruding strip corresponding to the accommodating groove is provided on an inner surface of the reverse roller jacket, and elastic components are respectively provided at two axial ends of the protruding strip to abut against the protruding strip in the case that the protruding strip is accommodated in the accommodating groove.

Further, the elastic components are rubber rings, and annular grooves configured to accommodate the rubber rings are provided in the outer surface of the inner sleeve.

Further, an elastic tooth corresponding to the accommodating groove is provided on each of the rubber rings.

Preferably, the reverse roller jacket includes a rigid sleeve and a rubber roller fixedly sleeved on the rigid sleeve.

Further, an accommodating groove is provided in an outer surface of the inner sleeve in an axial direction, a protruding strip corresponding to the accommodating groove is provided on an inner surface of the rigid sleeve, and elastic components are respectively provided at two axial ends of the protruding strip to abut against the protruding strip in the case that the protruding strip is accommodated in the accommodating groove.

Further, the elastic components are rubber rings, and annular grooves configured to accommodate the rubber rings are provided in the outer surface of the inner sleeve.

Further, an elastic tooth corresponding to the accommodating groove is provided on each of the rubber rings.

Preferably, the reverse roller is assembled on the reverse roller shaft by being borne by at least one one-way bearing and at least one normal bearing which are arranged in parallel with each other axially.

A self-service financial equipment is further provided according to the present application, which includes:

- a banknote depositing and withdrawing module configured to allow a user to deposit and withdraw banknotes;
- a conveying passage configured to convey a single sheet of banknotes;
- an identification module configured to identify the banknotes individually; and
- a cashbox configured to receive the identified and confirmed banknotes,
- wherein the banknote depositing and withdrawing module is provided with a sheet-type medium separating device which includes:
- a pickup roller assembly configured to frictionally convey one sheet of sheet type medium, in contact with the pickup roller assembly, in a whole stack of sheet-type media;
- a reverse roller assembly configured to block the whole stack of sheet-type media to prevent more than one sheet of the sheet-type media from being frictionally conveyed; and
- a separating roller assembly arranged opposite to the reverse roller assembly with a clearance passage being formed between the separating roller assembly and the reverse roller assembly and configured to convey a single sheet of the sheet-type media, and the separating roller assembly configured to provide a conveying power for a single sheet of the sheet-type media conveyed frictionally by the pickup roller assembly;
- wherein the reverse roller assembly includes a reverse roller, the reverse roller is assembled onto a reverse roller shaft through a one-way bearing, and the reverse roller includes an inner sleeve fixed to the one-way bearing and a reverse roller jacket sleeved on the inner sleeve and movable axially and elastically.

Preferably, an accommodating groove is provided in an outer surface of the inner sleeve in an axial direction, a protruding strip corresponding to the accommodating groove is provided on an inner surface of the reverse roller jacket, and elastic components are respectively provided at two axial ends of the protruding strip to abut against the protruding strip in the case that the protruding strip is accommodated in the accommodating groove.

Further, the elastic components are rubber rings, and annular grooves configured to accommodate the rubber rings are provided in the outer surface of the inner sleeve.

Further, an elastic tooth corresponding to the accommodating groove is provided on each of the rubber rings.

Preferably, the reverse roller jacket includes a rigid sleeve and a rubber roller fixedly sleeved on the rigid sleeve.

Further, an accommodating groove is provided in an outer surface of the inner sleeve in an axial direction, a protruding strip corresponding to the accommodating groove is provided on an inner surface of the rigid sleeve, and elastic components are respectively provided at two axial ends of the protruding strip to abut against the protruding strip in the case that the protruding strip is accommodated in the accommodating groove.

Further, the elastic components are rubber rings, and annular grooves configured to accommodate the rubber rings are provided in the outer surface of the inner sleeve.

Further, an elastic tooth corresponding to the accommodating groove is provided on each of the rubber rings.

Preferably, the reverse roller is assembled on the reverse roller shaft by being borne by at least one one-way bearing and at least one normal bearing which are arranged in parallel with each other axially.

The present application has the following advantageous effects compared with the conventional technology.

By designing the reverse roller to have a slightly elastic structure movable axially and elastically, the present application may dynamically and adaptively allocate a meshing clearance between the reverse roller and the separating roller according to the thickness of the separated sheet-type medium, thereby effectively addressing the issue that the sheet-type medium is jammed or tore in the separating process due to the uneven thickness of the sheet-type medium.

BRIEF DESCRIPTION OF THE DRAWINGS

For more clearly illustrating embodiments of the present application or the technical solutions in the conventional technology, drawings referred to describe the embodiments or the conventional technology will be briefly described hereinafter. Apparently, the drawings in the following description are only some examples of the present application, and for the person skilled in the art, other drawings may be obtained based on these drawings without any creative efforts.

DETAILED DESCRIPTION OF THE EMBODIMENTS

For further describing a device for depositing and withdrawing banknotes according to the present application, further description is made in detail hereinafter in conjunction with illustrations of a preferred embodiment of the present application.

Figure 1:
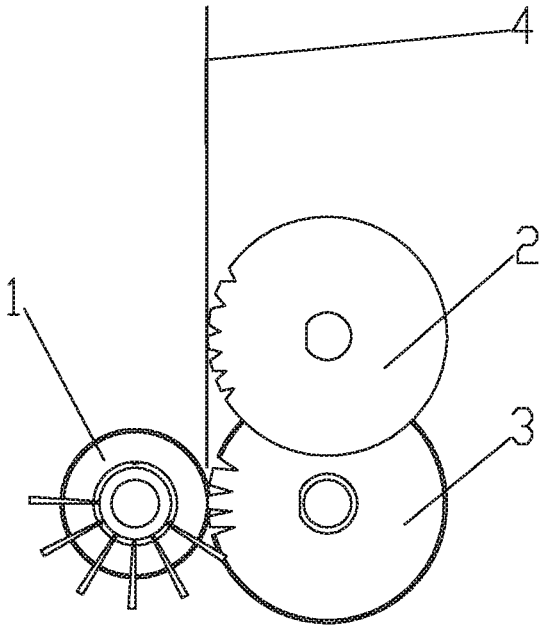
Fig. 1 Prior Art
FIG. 1 is a simplified schematic view of a sheet-type medium separating device.
Figure 2:
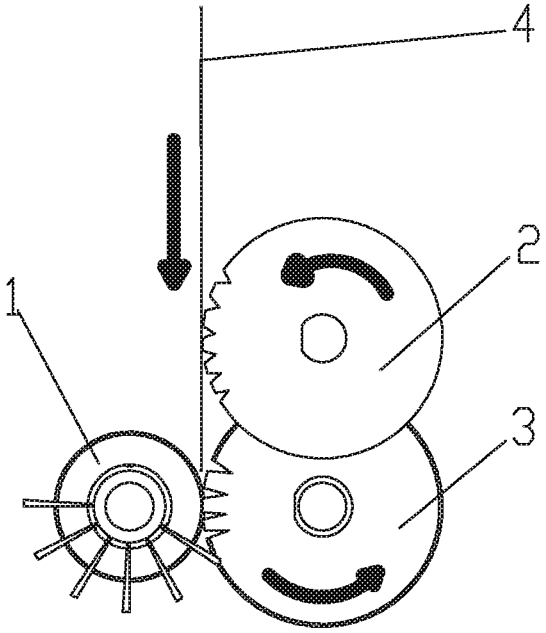
Fig. 2 Prior Art
FIG. 2 is a simplified schematic view showing the operating state of the sheet-type medium separating device shown in FIG. 1.
Figure 3:
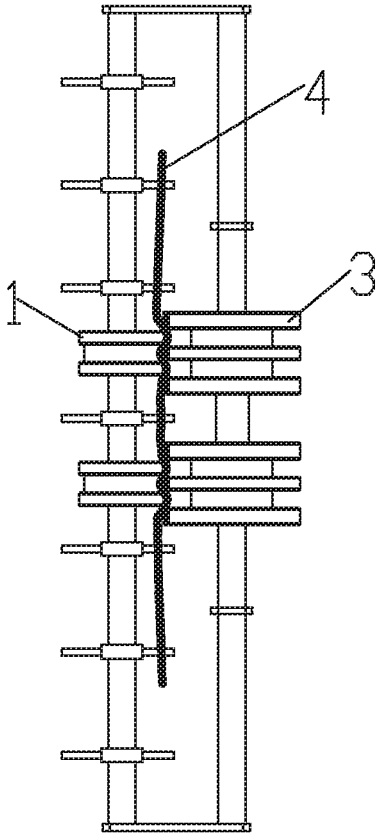
Fig. 3 Prior Art
FIG. 3 is a simplified schematic top view of the sheet-type medium separating device shown in FIG. 1.
Figure 4:
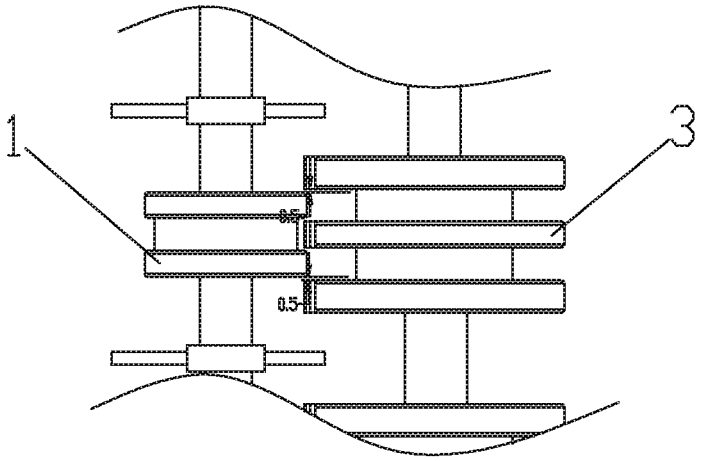
Fig. 4 Prior Art
FIG. 4 is a partially enlarged schematic view of the sheet-type medium separating device shown in FIG. 3.
Figure 5:
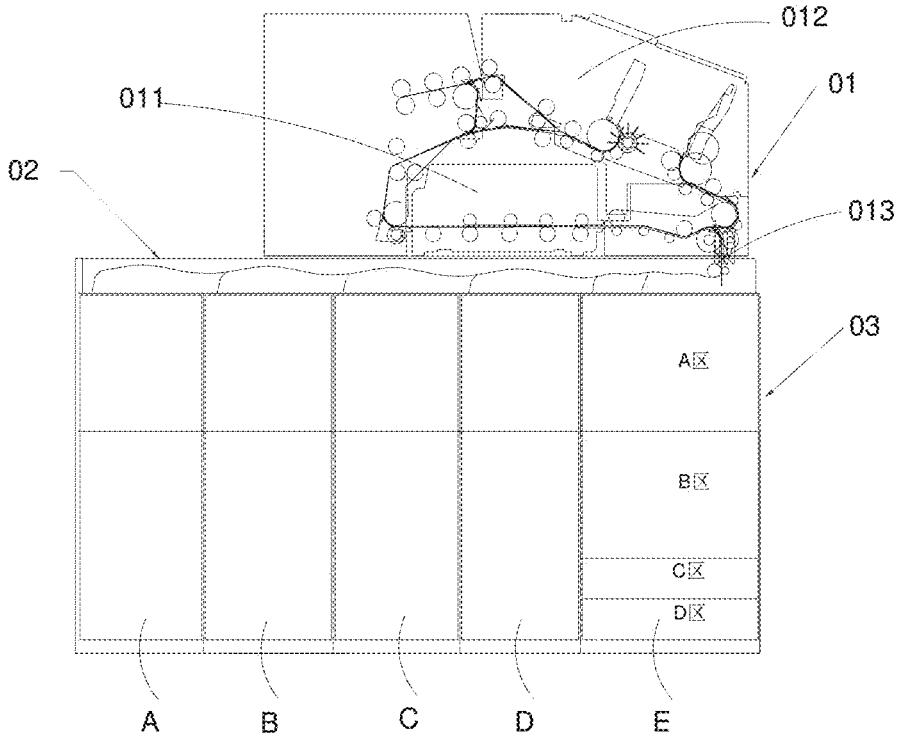
FIG. 5 is a schematic view showing the composition of a self-service financial equipment according to the present application.
Figure 6:
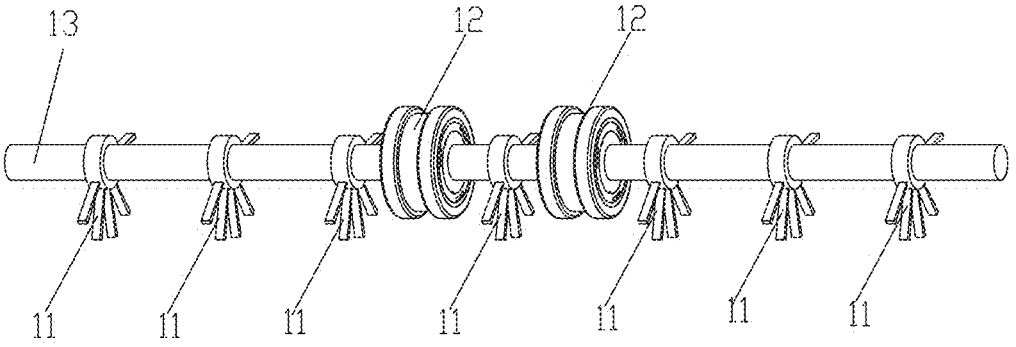
FIG. 6 is a schematic perspective view of a reverse roller assembly according to the present application.
Figure 7:
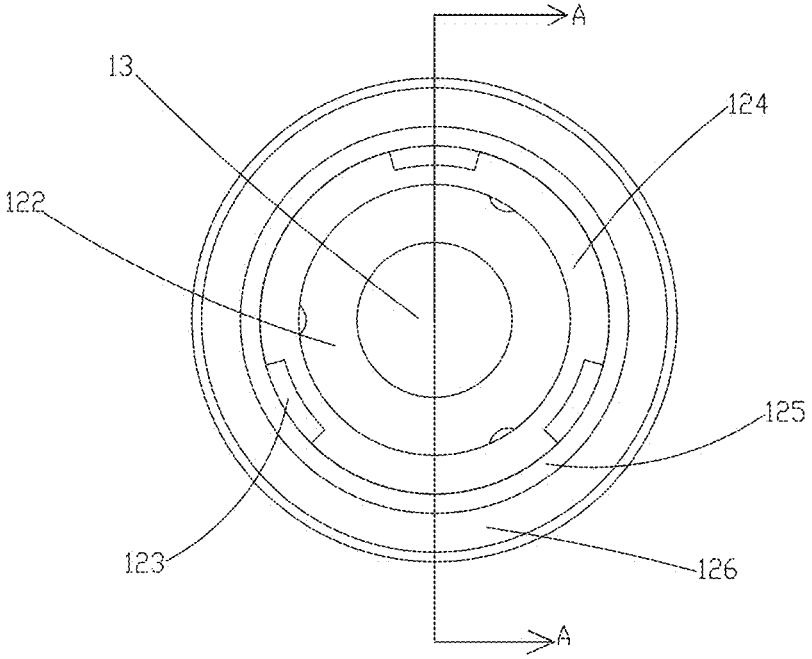
FIG. 7 is a schematic front view of a reverse roller in FIG. 6.

Reference is made to FIG. 5, which is a schematic view showing the composition of a self-service financial equipment. The self-service financial equipment includes an upper machine core 01 having a banknote identification module 011 and a banknote depositing and withdrawing module 012, a banknote conveying passage 02, and a lower machine core 03 having multiple cashboxes. In a process of depositing banknotes 10 into the automatic teller machine, the banknotes 10 are separated by a separating module and then individually pass through the banknote identification module 011, the banknotes, identified as acceptable, pass through a vertical passage 013 of a machine core connection mechanism and enter into the banknote conveying passage 02 in a horizontal direction, and the banknote conveying passage 02 conveys the banknotes into a corresponding cashbox according to an instruction from a control center (not shown).

Reference is made to FIGS. 1, 3, 5 and 6, the banknote depositing and withdrawing module includes a sheet-type medium separating device, and the sheet-type medium separating device includes a pickup roller assembly 2, a reverse roller assembly 1, and a separating roller assembly 3. The pickup roller assembly 2 is configured to frictionally convey one sheet of the sheet-type medium, that is in contact with the pickup roller assembly 2, in a whole stack of the sheet-type media. The reverse roller assembly 1 is configured to block the whole stack of the sheet-type media to prevent more than one sheet of the sheet-type media from being frictionally conveyed. The separating roller assembly 3 is arranged opposite to the reverse roller assembly with a clearance passage being formed between the separating roller assembly 3 and the reverse roller assembly 1 and configured to convey a single sheet of the sheet-type media, and the separating roller assembly 3 is configured to provide a conveying power for a single sheet of the sheet-type media conveyed frictionally by the pickup roller assembly. The reverse roller assembly 1 includes a reverse roller 12. The reverse roller 12 is assembled onto a reverse roller shaft 13 through a one-way bearing 122, and includes an inner sleeve 124 fixed to the one-way bearing 122, and a reverse roller jacket sleeved on the inner sleeve 124 and movable axially and elastically. In order to stably separate the sheet-type media, multiple wing rollers 11 are also provided on the reverse roller shaft 13.

Figure 8:
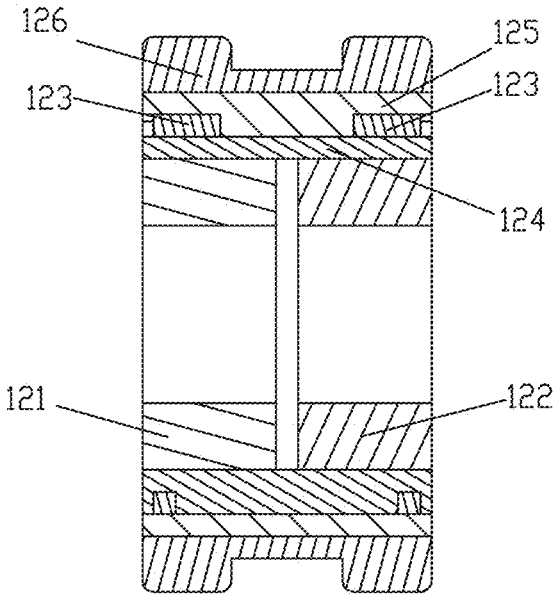
FIG. 8 is a sectional view of the reverse roller taken along the line A-A in FIG. 7.

Referring to FIG. 8, on the basis of ensuring performance and cost, the reverse roller 12 is assembled on the reverse roller shaft 13 by being borne by the one-way bearing 122 and at least one normal bearing 121 which are arranged in parallel with each other axially.

Figure 9:
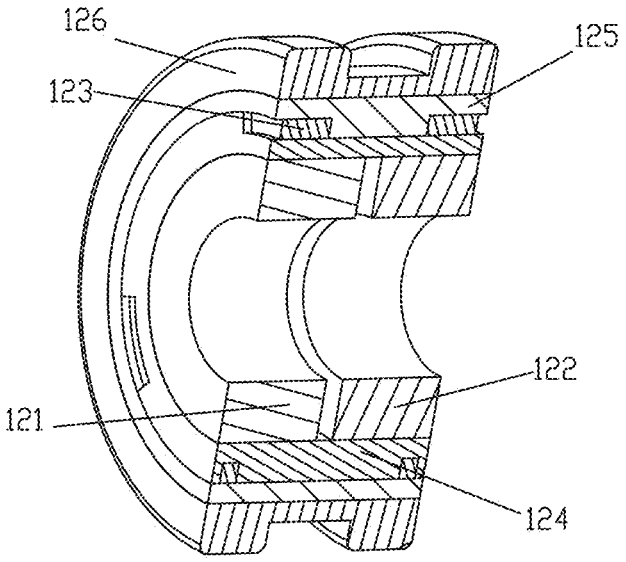
FIG. 9 is a perspective view of the sectional view shown in FIG. 8.
Figure 10:
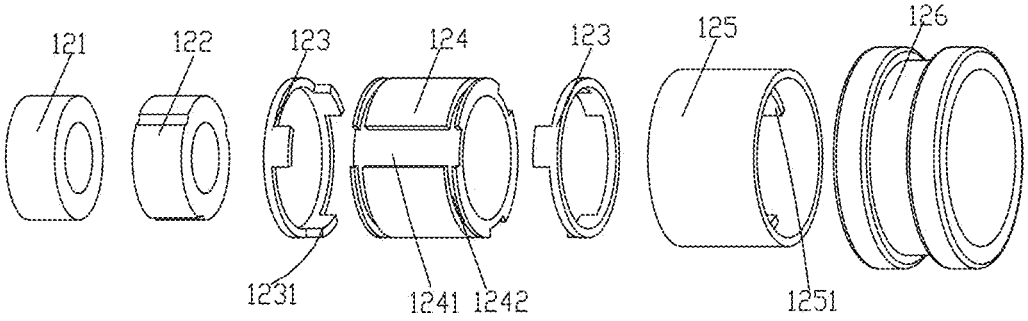
FIG. 10 is a schematic exploded view of the reverse roller in FIG. 6.

The structure of the reverse roller 12 is further described hereinafter in conjunction with FIGS. 9 and 10. The reverse roller 12 includes one normal bearing 121, one one-way bearing 122, one inner sleeve 124, the reverse roller jacket formed by a rigid sleeve 125 and a rubber roller 126, and an elastic component 123 arranged between the inner sleeve 124 and the rigid sleeve 125. An accommodating groove 1241 is provided in an outer surface of the inner sleeve 124 in an axial direction, and a protruding strip 1251 corresponding to the accommodating groove 1241 is provided on an inner surface of the rigid sleeve 125. The elastic component 123 is provided at each of two axial ends of the protruding strip 1241 to abut against the protruding strip 1251 after the protruding strip 1251 is accommodated in the accommodating groove 1241. In this embodiment, the elastic component 123 is a rubber ring, and to facilitate the assembly of the rubber rings, annular grooves 1242 for accommodating the rubber rings are provided in the outer surface of the inner sleeve 124. In order to ensure the axial movement amount of the reverse roller jacket, an elastic tooth 1231 corresponding to the accommodating groove is provided on the rubber ring.

Figure 11:
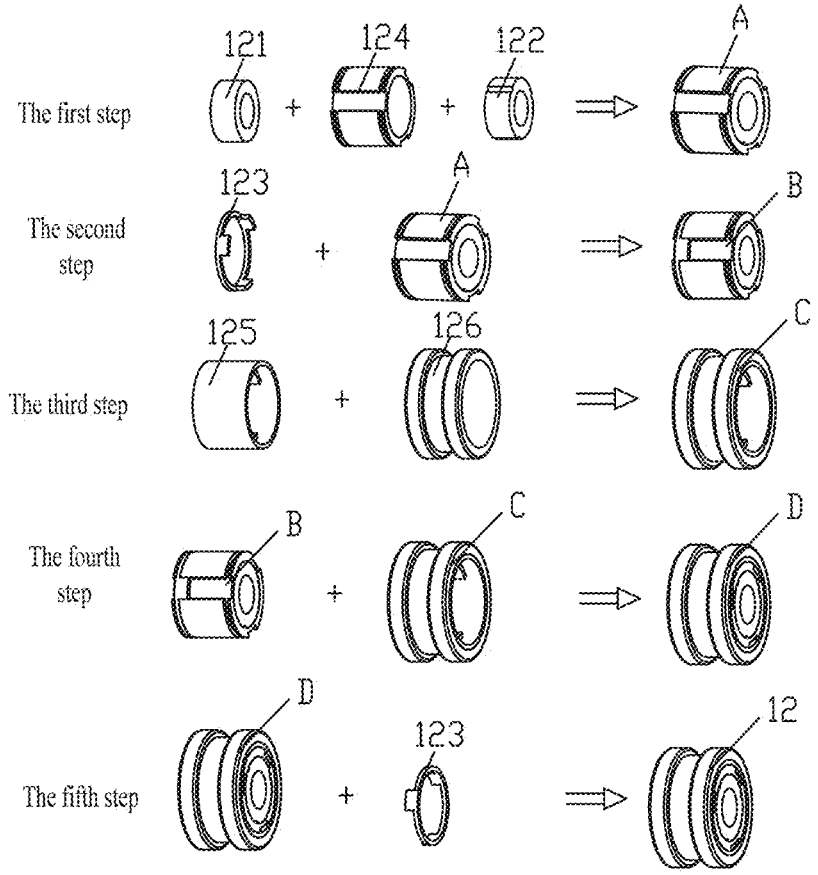
FIG. 11 is a flow chart showing assembling steps of the reverse roller shown in FIG. 6.

Referring to FIG. 11, the assembling process of the reverse roller is further illustrated.

In a first step, the normal deep groove ball bearing 121 and the one-way bearing 122 are fixed in an inner hole of the inner sleeve 124 by glue, to form an assembly A.

In a second step, the elastic rubber ring 123 is sleeved on one end of the assembly A assembled in the first step, to form an assembly B.

In a third step, the rigid outer sleeve 125 is fixed to an inner side of the rubber roller 126 by glue, to form an assembly C. This step may also be achieved by manufacturing the assembly integrally by injection molding in a factory;

In a fourth step, the assembly B assembled in the second step is slid into the assembly C assembled in the third step along the direction of the three guide grooves from one end of the assembly C, to form an assembly D.

In a fifth step, on the basis of the fourth step, the assembly C is continued to slide forward with respect to the assembly B, to cause the elastic rubber ring 123 to deform, until the other end of the inner sleeve 124 is exposed, then another elastic rubber ring 123 is sleeved on the other end of the assembly D, and the deformation of the elastic rubber pad 123 is released to allow the assembly B and the assembly C to return to the original positions and be centered relatively, to form the reverse roller 12.

Figure 12:
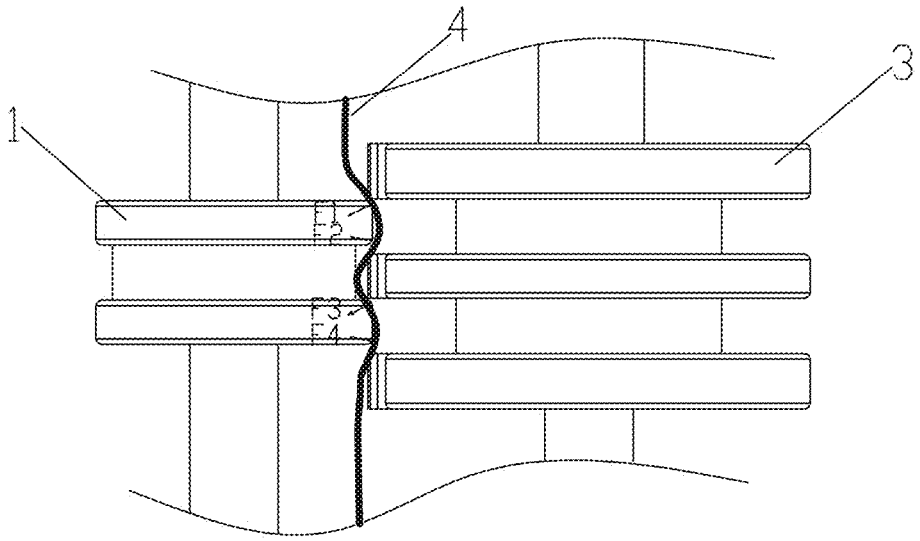
FIG. 12 is a schematic view showing the self-adaptive adjustment of the reverse roller shown in FIG. 6.

The principle of the reverse roller assembly dynamically and adaptively allocating a meshing clearance between the reverse roller and the separating roller is further described in conjunction with FIG. 12. Assuming that the axial distance between an upper end of the reverse roller 12 and an upper end of the separating roller 31 in the separating roller assembly 3 is relatively small, four simplified forces (the frictional force in the vertical plane is not taken into consideration) F1, F2, F3 and F4 are applied to the reverse roller in a horizontal plane by the separated banknote 4, and due to the different deformation degrees of the banknote at the four contact points, as shown in FIG. 12, the downward axial component of (F1+F3) is greater than the upward axial component of (F2+F4), thus, in this case, the axial resultant force applied on the reverse roller 12 is downward, and the assembly C within the reverse roller assembly moves downwards, which presses the elastic rubber pad 123 below the assembly C to deform, and the elastic rubber pad 123 returns to the original shape after the banknotes are wholly separated. Thus, the axial distance between the reverse roller 12 and the separating roller 31 can be well adjusted adaptively by the sheet-type medium separating device according to the thicknesses of the banknote in the banknote separating process, thereby effectively addressing the issue that the sheet-type medium is jammed or tore during the separating process due to the uneven thickness of the sheet-type medium.

The above description is only preferred embodiments of the present application. It should be noted that, the above preferred embodiments should not be deemed as a limitation to the present application, and the scope of the present application is defined by the claims of the present application. For the person skilled in the art, several improvements and modifications may be made to the present application without departing from the principle and scope of the present application, and these improvements and modifications are also deemed to fall into the scope of the present application.

The invention claimed is:

1. A sheet-type medium separating device, comprising:

a pickup roller assembly configured to frictionally convey one sheet of sheet type medium, in contact with the pickup roller assembly, in a whole stack of sheet-type media;

a reverse roller assembly configured to block the whole stack of sheet-type media to prevent more than one sheet of the sheet-type media from being frictionally conveyed; and a separating roller assembly arranged opposite to the reverse roller assembly with a clearance passage being formed between the separating roller assembly and the reverse roller assembly and configured to convey a single sheet of the sheet-type media, and the separating roller assembly configured to provide a conveying power for a single sheet of the sheet-type media conveyed frictionally by the pickup roller assembly;

wherein the reverse roller assembly comprises a reverse roller, the reverse roller is assembled onto a reverse roller shaft through a one-way bearing, and the reverse roller comprises an inner sleeve fixed to the one-way bearing and a reverse roller jacket sleeved on the inner sleeve and movable axially and elastically, wherein an accommodating groove is provided in an outer surface of the inner sleeve in an axial direction, a protruding strip corresponding to the accommodating groove is provided on an inner surface of the reverse roller jacket, and elastic components are respectively provided at two axial ends of the protruding strip to abut against the protruding strip in the case that the protruding strip is accommodated in the accommodating groove.

2. The sheet-type medium separating device according to claim 1, wherein the elastic components are rubber rings, and annular grooves configured to accommodate the rubber rings are provided in the outer surface of the inner sleeve.

3. The sheet-type medium separating device according to claim 2, wherein an elastic tooth corresponding to the accommodating groove is provided on each of the rubber rings.

4. The sheet-type medium separating device according to claim 1, wherein the reverse roller jacket comprises a rigid sleeve and a rubber roller fixedly sleeved on the rigid sleeve.

5. The sheet-type medium separating device according to claim 4, wherein an accommodating groove is provided in an outer surface of the inner sleeve in an axial direction, a protruding strip corresponding to the accommodating groove is provided on an inner surface of the rigid sleeve, and elastic components are respectively provided at two axial ends of the protruding strip to abut against the protruding strip in the case that the protruding strip is accommodated in the accommodating groove.

6. The sheet-type medium separating device according to claim 5, wherein the elastic components are rubber rings, and annular grooves configured to accommodate the rubber rings are provided in the outer surface of the inner sleeve.

7. The sheet-type medium separating device according to claim 6, wherein an elastic tooth corresponding to the accommodating groove is provided on each of the rubber rings.

8. The sheet-type medium separating device according to claim 1, wherein the reverse roller is assembled on the reverse roller shaft by being borne by at least one one-way bearing and at least one normal bearing which are arranged in parallel with each other axially.

9. A self-service financial equipment, comprising:

a banknote depositing and withdrawing module configured to allow a user to deposit and withdraw banknotes;

a conveying passage configured to convey a single sheet of banknotes;

an identification module configured to identify the banknotes individually; and a cashbox configured to receive the identified and confirmed banknotes, wherein the banknote depositing and withdrawing module comprises a sheet-type medium separating device, and sheet-type medium separating device, comprises:

a pickup roller assembly configured to frictionally convey one sheet of sheet type medium, in contact with the pickup roller assembly, in a whole stack of sheet-type media;

a reverse roller assembly configured to block the whole stack of sheet-type media to prevent more than one sheet of the sheet-type media from being frictionally conveyed; and a separating roller assembly arranged opposite to the reverse roller assembly with a clearance passage being formed between the separating roller assembly and the reverse roller assembly and configured to convey a single sheet of the sheet-type media, and the separating roller assembly configured to provide a conveying power for a single sheet of the sheet-type media conveyed frictionally by the pickup roller assembly;

wherein the reverse roller assembly comprises a reverse roller, the reverse roller is assembled onto a reverse roller shaft through a one-way bearing, and the reverse roller comprises an inner sleeve fixed to the one-way bearing and a reverse roller jacket sleeved on the inner sleeve and movable axially and elastically, wherein an accommodating groove is provided in an outer surface of the inner sleeve in an axial direction, a protruding strip corresponding to the accommodating groove is provided on an inner surface of the reverse roller jacket, and elastic components are respectively provided at two axial ends of the protruding strip to abut against the protruding strip in the case that the protruding strip is accommodated in the accommodating groove.

10. The self-service financial equipment according to claim 9, wherein the elastic components are rubber rings, and annular grooves configured to accommodate the rubber rings are provided in the outer surface of the inner sleeve.

11. The self-service financial equipment according to claim 10, wherein an elastic tooth corresponding to the accommodating groove is provided on each of the rubber rings.

12. The self-service financial equipment according to claim 9, wherein the reverse roller jacket comprises a rigid sleeve and a rubber roller fixedly sleeved on the rigid sleeve.

13. The self-service financial equipment according to claim 12, wherein an accommodating groove is provided in an outer surface of the inner sleeve in an axial direction, a protruding strip corresponding to the accommodating groove is provided on an inner surface of the rigid sleeve, and elastic components are respectively provided at two axial ends of the protruding strip to abut against the protruding strip in the case that the protruding strip is accommodated in the accommodating groove.

14. The self-service financial equipment according to claim 13, wherein the elastic components are rubber rings, and annular grooves configured to accommodate the rubber rings are provided in the outer surface of the inner sleeve.

15. The self-service financial equipment according to claim 14, wherein an elastic tooth corresponding to the accommodating groove is provided on each of the rubber rings.

16. The self-service financial equipment according to claim 9, wherein the reverse roller is assembled on the reverse roller shaft by being borne by at least one one-way bearing and at least one normal bearing which are arranged in parallel with each other axially.

* * * * *